US007140216B2

(12) United States Patent
Garza

(10) Patent No.: US 7,140,216 B2
(45) Date of Patent: Nov. 28, 2006

(54) LASER ALIGNED SHOTPEEN NOZZLE

(75) Inventor: Jose Abiel Garza, McAllen, TX (US)

(73) Assignee: General Electric Company, Schenectady, NY (US)

( * ) Notice: Subject to any disclaimer, the term of this patent is extended or adjusted under 35 U.S.C. 154(b) by 142 days.

(21) Appl. No.: 10/991,816

(22) Filed: Nov. 18, 2004

(65) Prior Publication Data

US 2006/0101883 A1 May 18, 2006

(51) Int. Cl.

| | |
|---|---|
| ***B24C 1/00*** | (2006.01) |
| ***C21D 7/06*** | (2006.01) |
| *B21J 1/02* | (2006.01) |
| *B23K 26/00* | (2006.01) |

(52) U.S. Cl. ..... 72/53; 29/90.7; 148/525; 219/121.69

(58) Field of Classification Search ..... 72/53; 148/525; 219/121.69, 121.85; 29/90.7
See application file for complete search history.

(56) References Cited

U.S. PATENT DOCUMENTS

| | | | | |
|---|---|---|---|---|
| 3,937,055 | A | | 2/1976 | Caruso et al. |
| 4,152,754 | A | | 5/1979 | DeFilippis et al. |
| 4,401,477 | A | * | 8/1983 | Clauer et al. ..... 148/525 |
| 4,420,957 | A | | 12/1983 | Weber |
| 4,432,220 | A | | 2/1984 | Loersch et al. |
| D282,771 | S | | 2/1986 | Garrison |
| 4,604,881 | A | | 8/1986 | Lienert |
| 4,724,299 | A | | 2/1988 | Hammeke |
| 4,937,421 | A | * | 6/1990 | Ortiz et al. ..... 219/121.69 |
| 5,212,976 | A | * | 5/1993 | Company ..... 29/90.7 |
| 5,306,360 | A | * | 4/1994 | Bharti et al. ..... 148/525 |
| 5,671,628 | A | * | 9/1997 | Halila et al. ..... 72/53 |
| 5,948,293 | A | * | 9/1999 | Somers et al. ..... 72/53 |
| 5,993,681 | A | | 11/1999 | Glogovsky |
| 6,075,593 | A | | 6/2000 | Trantow et al. |
| 6,374,158 | B1 | | 4/2002 | Fusaro |
| 6,483,076 | B1 | * | 11/2002 | O'Loughlin et al. ... 219/121.85 |
| 6,490,899 | B1 | | 12/2002 | Berthelet et al. |
| 6,715,701 | B1 | | 4/2004 | Julien |
| 6,759,626 | B1 | | 7/2004 | Clauer et al. |

* cited by examiner

*Primary Examiner*—David B. Jones
(74) *Attorney, Agent, or Firm*—V. G. Ramaswamy; Francis L. Conte

(57) ABSTRACT

A shotpeen nozzle includes a tubular core mounted in a casing. The casing has an inlet for receiving shot in a stream of pressurized air, and the core includes an outlet for discharging the stream. A laser is mounted to the casing for projecting a laser beam in parallel with the core at its outlet in the direction of discharge of the stream therefrom.

20 Claims, 3 Drawing Sheets

LASER ALIGNED SHOTPEEN NOZZLE

BACKGROUND OF THE INVENTION

The present invention relates generally to manufacturing processes, and, more specifically, to shot peening of workpieces.

Metal components or parts are typically manufactured in multiple steps to achieve the final size, configuration, and surface finish thereof. Metal components may be cast in complex three dimensional (3D) configurations, with and without subsequent precision machining of various surfaces thereof.

A gas turbine engine includes many complex 3D parts cast and machined for use in various components thereof. Turbine rotor blades include an airfoil extending outwardly from a supporting platform and dovetail. The dovetail is configured with axial lobes or tangs for mounting each blade in corresponding dovetail slots in the perimeter of a supporting rotor disk.

During operation, energy is extracted from hot combustion gases that flow past the turbine rotor blades which in turn rotate the supporting rotor disk for powering a compressor in a typical configuration. The blades are subject to centrifugal loads during operation, which loads are carried radially inwardly through the supporting dovetails into the perimeter of the rotor disk.

The turbine blades are typically formed of high strength superalloy material having enhanced strength at the elevated temperatures typically found in the turbine. To further enhance the strength of the turbine rotor blades the various surfaces of the dovetails may be shot peened in one of the last manufacturing steps producing the blades.

Shot peening is a mature process in which metal shot is discharged in stream of pressurized air over the surface of a metal workpiece to plastically deform the surface layer thereof and introduce residual compressive stress therein. The residual compressive stress reduces the stresses experienced in the component during operation, such as in the rotating environment of the gas turbine engine.

Since the shot peening process is effected at the end of the manufacturing cycle for the typical component, corresponding care must be used in the process to avoid damaging the component or incompletely shot peening the intended surface thereof. Uniform shot peening of the entire turbine blade dovetail, for example, will ensure maximum strength of the blade during operation and a correspondingly long service life.

However, shot peening adds to the time and cost of manufacture of components, such as the turbine blades, and in the typical gas turbine engine a multitude of turbine blades are found and must be suitably manufactured at competitive cost.

In one conventional shot peening apparatus enjoying many years of successful commercial service in the United States, individual turbine blades are mounted upside down in corresponding supporting cans which expose upwardly the corresponding dovetail while protecting the turbine airfoil inside the can.

Eight blades in corresponding cans may be mounted to the perimeter of a supporting turntable inside a fully enclosed cabinet for performing shot peening of the blade dovetails. Each can is indexed into position next to a gang or set of shot peening nozzles mounted from a common support rod. The individual nozzles in the set are manually aligned with a single dovetail for aiming the shot stream at a common target point thereon.

During operation, the cabinet is closed, and the support rod for the nozzles oscillates vertically for discharging the shot stream simultaneously from the set of nozzles over the surface area of the blade dovetail as it rotates with the can on the common turntable.

In less than a minute per blade, the entire dovetail may be suitably shot peened over its full exposed surface notwithstanding the serpentine configuration of the serrations or dovetail lobes thereon. The use of accurately aligned multiple shotpeen nozzles ensures accurate shot peening of the dovetail as it rotates during the process while the nozzles oscillate vertically.

However, each of the multiple nozzles requires corresponding initial alignment relative to the corresponding blade workpiece supported in the can, which alignment is typically done manually by an operator and therefore extends the setup time of the process.

Furthermore, two sets of shotpeen nozzles may be mounted inside the cabinet from corresponding supporting rods for permitting the simultaneous shot peening of two blade dovetails in their corresponding supporting cans.

Each of these multiple shotpeen nozzles must be independently aligned with the corresponding workpiece. And, each of the nozzles in each set must also be aligned relative to each other for ensuring the coincidence of the separate shot streams therefrom at a common target point on the workpiece.

The blade workpieces are typically shot peened in large batches following the initial alignment of the nozzles in the cabinet. The blades are simply inserted into the corresponding supporting cans for shot peening thereof and replaced by subsequent turbine blades until the full batch of blades has been shot peened. Prior to the next batch of blades requiring shot peening, the alignment of the shotpeen nozzles is measured in a conventional manner using Almen strips, with the multiple nozzles being realigned if required.

Accordingly, it is desired to provide an improved shotpeen nozzle in a multi-nozzle apparatus for shot peening workpieces with improved alignment of the nozzles.

BRIEF DESCRIPTION OF THE INVENTION

A shotpeen nozzle includes a tubular core mounted in a casing. The casing has an inlet for receiving shot in a stream of pressurized air, and the core includes an outlet for discharging the stream. A laser is mounted to the casing for projecting a laser beam in parallel with the core at its outlet in the direction of discharge of the stream therefrom.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
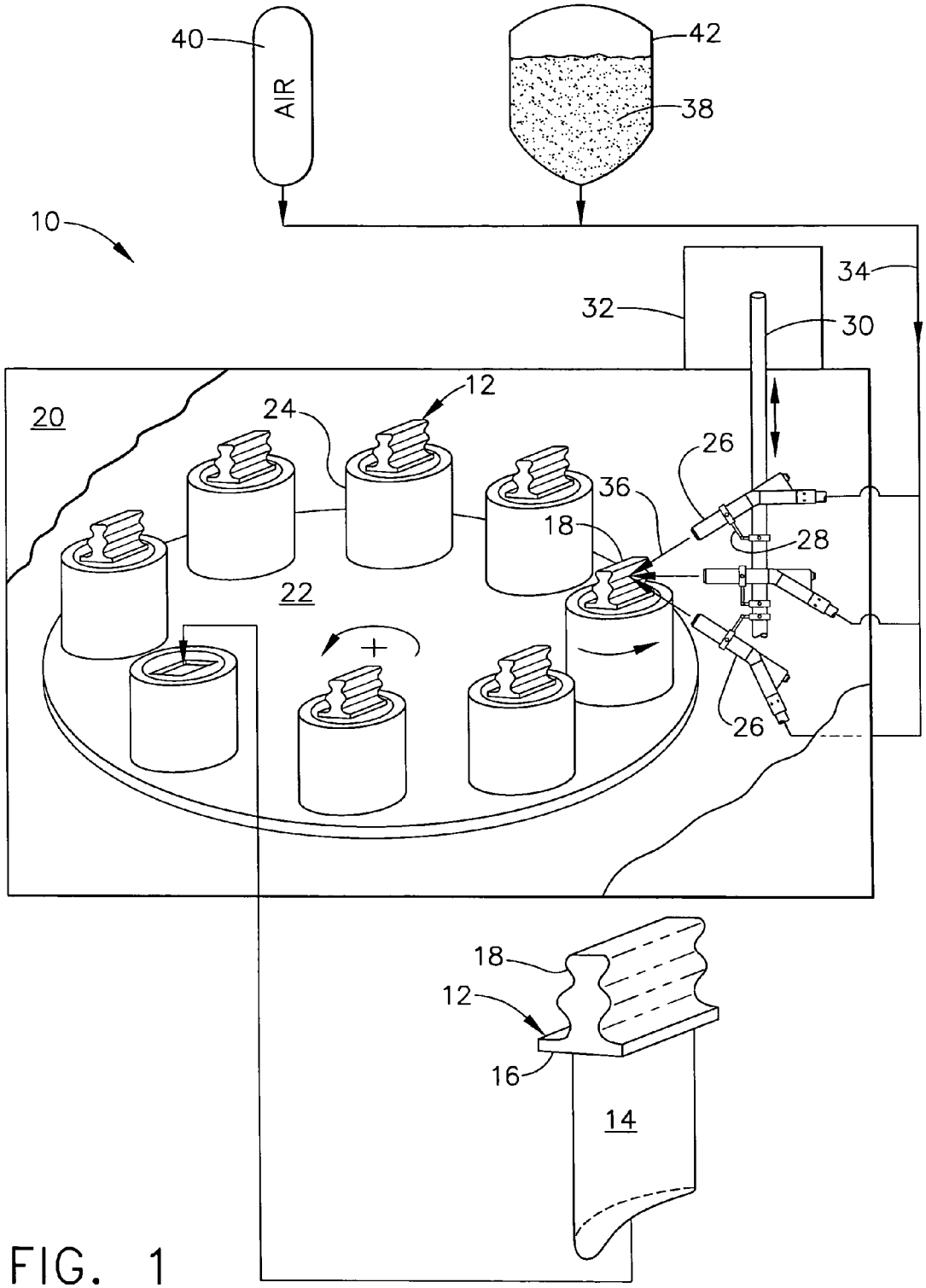
FIG. 1 is a schematic representation of an apparatus for shot peening in turn a plurality of workpieces inside a cabinet.

Illustrated schematically in FIG. 1 is an apparatus 10 for shot peening a workpiece 12 in the exemplary form of a gas turbine engine rotor blade. The blade includes an airfoil 14 extending outwardly from a supporting platform 16 integrally formed with a dovetail 18.

The dovetail 18 is conventional and is configured as an axial-entry dovetail with a plurality of serrations or dovetail lobes configured for mounting the blade to the perimeter of a supporting rotor disk (not shown) having corresponding axial dovetail slots extending through the perimeter thereof.

The shot peening apparatus 10 includes a suitable housing or cabinet 20 in which is mounted a rotary turntable 22. Mounted around the circumference of the turntable are a plurality of rotary cans 24, such as eight, in which corresponding ones of the workpiece blades 12 are suitably mounted upside down to expose the corresponding dovetails 18 while hiding and protecting the airfoils 14 therein. Each can includes a suitable rubber boot specifically configured for mounting the 3D airfoil and protecting it from abrasion during the shot peening operation.

The turntable 22 is mounted in the cabinet for rotation about its centerline axis for indexing corresponding ones of the cans 24 and the blades 12 supported therein in turn for undergoing shot peening. The individual cans 24 are suitably mounted on the turntable for powered rotation about their centerline axes during the shot peening process.

A plurality of shotpeen nozzles 26 are mounted by corresponding adjustable brackets 28 to a common support rod 30 inside the cabinet 20. The support rod 30 is in turn suspended from a suitable carriage 32 configured for oscillating the rod and nozzles attached thereto in vertical translation inside the cabinet during operation.

But for the nozzles 26, the shotpeen apparatus illustrated in FIG. 1 may have any conventional configuration and operation for conducting shot peening of the workpieces 12. For example, one shot peening apparatus used for many years in commercial service in the USA was purchased from Empire Abrasive Equipment Company, of Langhorne, Pa. under Model No. TT48-5.

This apparatus includes high strength, rubber supply hoses 34 joined to respective ones of the improved nozzles 26, instead of conventional nozzles originally provided with the machine, for delivering a stream 36 of small metal shot 38 in pressurized air 40 for shot peening of the blade dovetails 18. The shot 38 is initially contained in a suitable hopper 42 and is delivered by gravity into the pressurized airstream commonly provided by shop air contained in a storage tank or accumulator.

Figure 2:
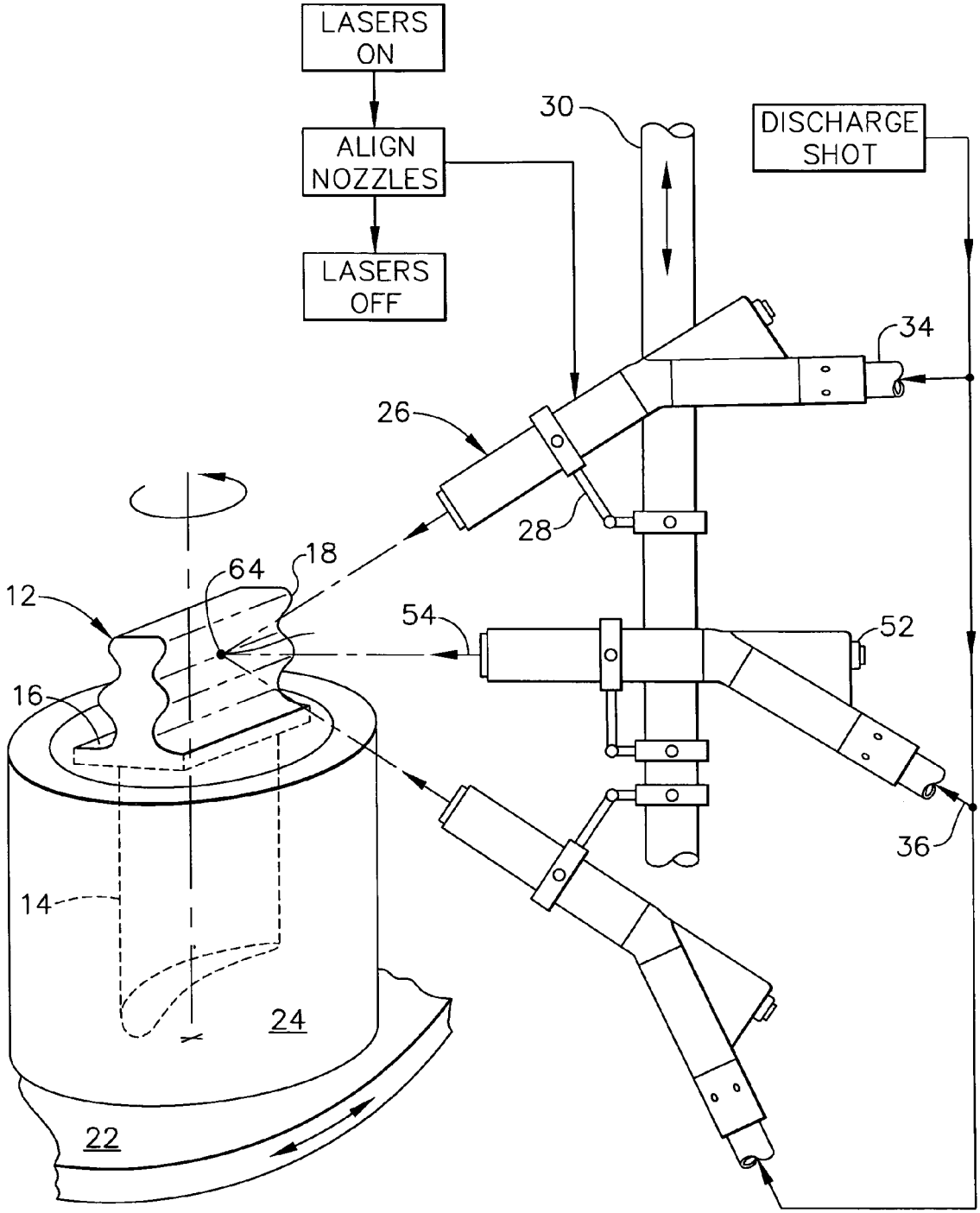
FIG. 2 is a schematic representation of a set of shotpeen nozzles mounted in the cabinet of FIG. 1 for shot peening a workpiece mounted in a supporting can therein.
Figure 3:
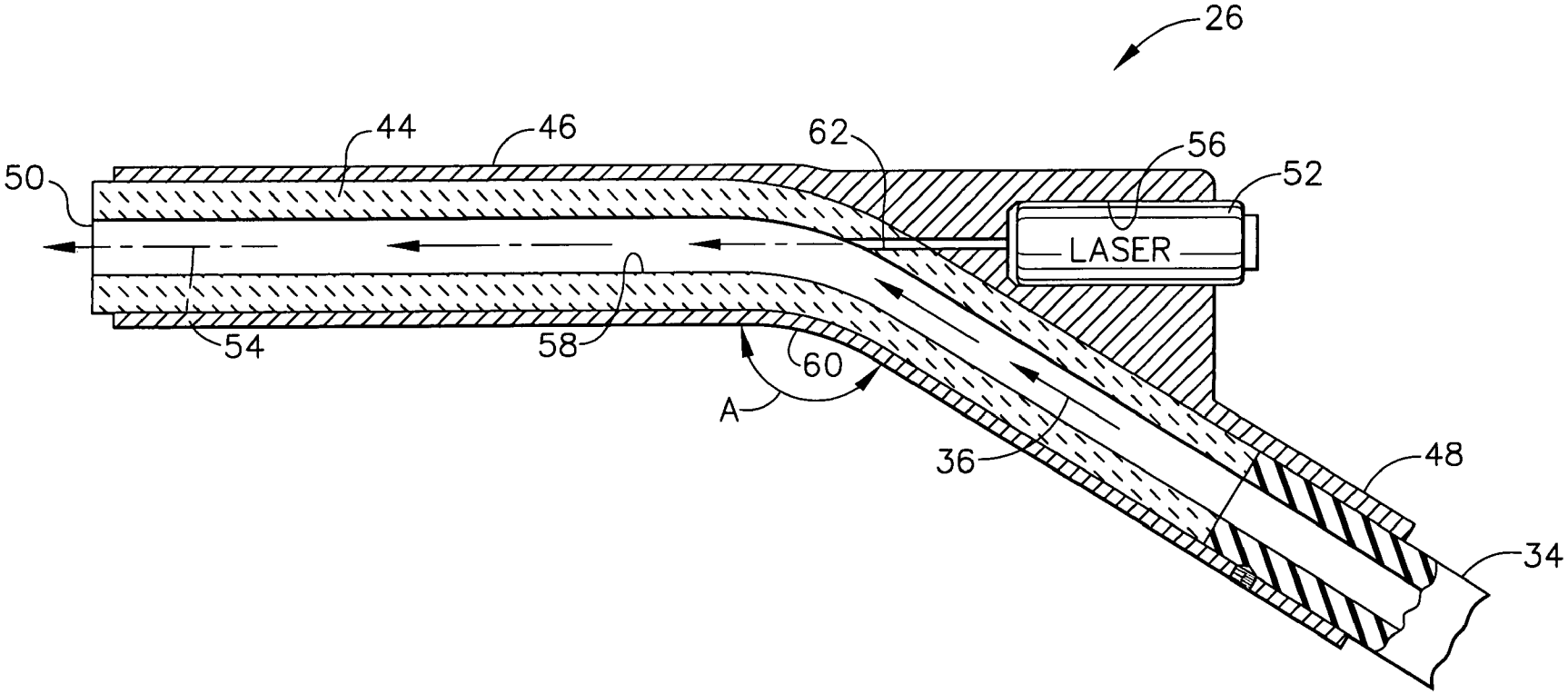
FIG. 3 is a longitudinal sectional view through an exemplary one of the shotpeen nozzles illustrated in FIG. 2.

FIG. 2 illustrates schematically three identical nozzles 26 mounted by corresponding brackets 28 to the common vertical support rod 30 inside the cabinet of FIG. 1. FIG. 3 illustrates in more particularity an exemplary configuration of the shotpeen nozzles illustrated in FIG. 2.

The exemplary nozzle 26 illustrated in FIG. 3 includes an abrasion resistant tubular core 44 suitably mounted inside a tubular metal casing 46. The core may be formed of conventional carbide typically used in shotpeen nozzles for the enhanced abrasion resistance capability thereof when metal shot is discharged therethrough. Due to the hard and rigid character of the carbide core it is brittle, and it is therefore mounted in the metal casing for support thereof, with the casing being typically formed of stainless steel.

The casing 46 has an inlet 48 at a proximal end thereof for receiving or mounting the supply hose 34 in flow communication with the corresponding end of the core 44. The casing inlet 48 is in the form of a counterbore or socket in which the distal end of the hose 34 may be inserted and fixedly joined thereto using suitable set screws for example.

The core 44 has an outlet 50 at an opposite distal end of the casing for discharging the shot stream 36 received from the hose 34 during shotpeen operation.

Each shotpeen nozzle 26 further includes a suitable laser 52 mounted to the casing 46 for projecting a visible laser beam 54 in parallel with the core 44 at the outlet 50 thereof in the same direction of discharge of the stream 36 from the outlet 50. The laser may have any conventional configuration such as a small battery operated red laser, with a simple push button on-off switch.

As further described hereinbelow, the laser 52 significantly improves the accuracy and speed of initial alignment of the individual nozzles 26 inside the cabinet illustrated in FIG. 1 prior to shot peening operation, and also decreases the down time between batch processing of the workpieces and re-alignment of the nozzles.

The metal casing 46 illustrated in FIG. 3 preferably also includes an integral pocket 56 in which the laser 52 may be conveniently mounted, with the pocket surrounding in most part the laser for protecting it from ricochet of the shot 38 during operation. Since the laser 52 is an integral component of the nozzle 46 it resides inside the closed cabinet 20 illustrated in FIG. 1 during operation and is itself subject to ricochet of the shot being discharged under high pressure from the corresponding nozzles 26.

In the preferred embodiment illustrated in FIG. 3, the core 44 also includes a center bore 58 extending completely longitudinally therethrough between the inlet 48 and outlet 50 at opposite ends thereof. The laser 52 is mounted in the casing 46 to project the laser beam 54 coaxially with the bore 58 at the core outlet 50. In this way, the projecting laser beam 54 is coincident with the direction of the shot stream 36 later discharged through the nozzle during the shot peening process.

This preferred alignment of the laser 52 may be effected by providing a bowed core 44 that includes a shallow bow or bend 60 disposed at an intermediate longitudinal position between the inlet 48 and outlet 50. A small access hole 62 extends through the bend of the core and is coaxially aligned with the center bore 58 thereof.

The laser 52 is mounted in the casing 46 behind the bend 60 and is coaxially aligned with the access hole 62 and bore 58 for projecting the laser beam 54 coaxially therethrough and out the center of the core outlet 50 during the alignment process. In this configuration, the laser 52 is hidden inside the casing pocket 56 behind the discharge end of the nozzle which further protects the laser from ricochet damage from the shot during the peening operation.

Since the shot being carried through the supply hose 44 is abrasive, the carbide core 44 is preferably straight on opposite ends or sides of the middle bend 60 therein, with a large obtuse bend angle A between the two straight ends of the core and casing. The bend angle A may be about 150 degrees for example and should be as large as practical for introducing a shallow bend in the nozzle sufficient for mounting the laser to project the laser beam coaxially through the discharge end of the core.

The bend 60 between the two straight ends of the carbide core 44 has a smooth internal surface which promotes the smooth turning of the shot stream between the inlet and outlet ends of the core during shot peening operation.

The diameter of the access hole 62 may be as small as practical and corresponds generally with the diameter of the laser beam 54 itself, which in turn is a very small minor portion of the diameter of the center bore 58 of the core through which the shot stream is discharged during peening operation. Since the access hole 62 is disposed on the upstream side of the bend 60 and faces downstream in alignment with the discharge end of the core, the shot being carried by the core during operation travels away from the access hole 62 to prevent obstruction or clogging thereof during operation.

A method of using the shotpeen nozzle 26 illustrated in FIG. 3 is shown schematically in FIG. 2. Initially, the laser 52 is turned on to project the laser beam 54 through the center bore 58 of the nozzle and out the core outlet 50 towards the workpiece 12 which requires shot peening. The workpiece 12 is fixedly mounted in the supporting can 24 atop the turntable 22, and the individual nozzles 26 are mounted to the common support rod 30 by the corresponding brackets 28.

The brackets 28 are adjustable with articulated joints and fasteners or screws as desired and are manually adjustable by the operator for aligning each nozzle 26 to aim the laser beam 54 at a suitable target 64 on the workpiece supported in the can 24. In this way, each nozzle may be suitably aligned using the laser beam 54 as the guide to determine the impact point of the shot which is subsequently discharged through the nozzles toward the workpiece.

The laser is then turned off upon completion of the alignment process. Shot peening operation may then be commenced by discharging the stream 36 of shot 38 in the pressurized air 40 through the corresponding hoses 34 and nozzles 26 for shot peening the specific workpiece 12 within the aim of one or more of the nozzles.

As indicated above, a plurality of the nozzles 26, such as the three illustrated in FIG. 2, are mounted from the common support rod 30 which oscillates vertically during shot peening process. Each of the three nozzles is identically constructed as illustrated in FIG. 3, with each nozzle including the laser 52 coaxially aligned with the discharge end of the carbide bore 44 for projecting the visible laser beam 54 from the center of the outlet 50 thereof.

All three lasers 52 are then turned on during the alignment process to project corresponding laser beams 54 from the corresponding outlets of the three nozzles toward the common workpiece 12.

Since the dovetail 18 undergoing the shot peening process has serpentine lobes or serrations which vary in facing direction, the three nozzles 26 are spaced apart vertically from each other and in different planes and angular orientations as desired to reach the workpiece from different angles of attack. The three laser beams 54 projecting out from each of the three nozzles readily permits the individual alignment of each nozzle 26 as required so that the three beams are aligned to the common target 64 on the workpiece 12 from the different attack angles of the three nozzles.

Once the three nozzles are accurately aligned to the common target 64, and the corresponding brackets 28 locked in position on the common support rod 30, all three lasers 52 of the three nozzles may then be turned off. The shot peening process may then commence by discharging respective streams 36 of the shot 38 in the pressurized air 40 from each of the nozzles simultaneously toward the target on the workpiece for shot peening thereof.

The cans 24 and workpieces 12 supported therein are rotated during the shot peening process, while the support rod 30 oscillates vertically to shot peen the entire external surface of the blade dovetail 18 in the same manner provided in the conventional apparatus disclosed above.

However, the improved laser-guided shotpeen nozzles 26 substantially decrease the initial alignment time for the three nozzles. And, following shot peening of a batch of the workpieces, the conventional Almen strips may be used to check alignment of the three nozzles, or the shot peening apparatus may be temporarily shut off to examine alignment of the nozzles by turning on the lasers for checking in-situ alignment with the workpiece.

Notwithstanding the hostile environment inside the shot peening cabinet illustrated in FIG. 1, the lasers 52 may be preferentially integrated into the shotpeen nozzles for enhancing initial alignment thereof, while also protecting the lasers themselves from ricochet damage inside the cabinet. The individual nozzles may be accurately aligned with the corresponding workpiece, as well as aligned with each other for focusing the different laser beams to the common target, which in turn ensures focused alignment of the different shot streams from the several nozzles operated during operation. Furthermore, it may also be possible to operate the lasers during the shot peening process itself to visibly observe and confirm accurate alignment of the different shot streams during in-situ processing of the individual workpieces.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A shotpeen nozzle comprising:

a bowed carbide core having a center bore extending longitudinally therethrough, and mounted in a metal casing;

said casing having an inlet at a proximal end for mounting a supply hose in flow communication with said core to receive shot in a stream with pressurized air;

said core having an outlet at an opposite distal end of said casing for discharging said stream; and a laser mounted in said casing for projecting a visible laser beam in parallel with said core at said outlet in the direction of discharge of said stream from said outlet.

2. A nozzle according to claim 1 wherein:

said core further includes a bend disposed between said inlet and outlet, and a hole extending through said bend and coaxially aligned with said bore; and said laser is mounted in said casing behind said bend and coaxially aligned with said hole and bore for projecting said laser beam therethrough and out said outlet.

3. A nozzle according to claim 2 wherein said core is straight on opposite sides of said bend, with an obtuse bend angle therebetween.

4. A nozzle according to claim 3 wherein said casing further includes a pocket disposed behind said bend and surrounding said laser in most part to protect said laser from ricochet of said shot.

5. A nozzle according to claim 4 wherein said hole has a diameter corresponding with the diameter of said laser beam, and is a minor portion of the diameter of said bore.

6. A method of using said shotpeen nozzle according to claim 5 comprising:

turning on said laser to project said laser beam through said bore and out said outlet toward a workpiece;

aligning said nozzle to aim said laser beam at a target on said workpiece;

turning off said laser; and discharging said stream of shot in said pressurized air toward said workpiece for shot peening thereof.

7. A plurality of shotpeen nozzles according to claim 5 mounted by corresponding brackets to a common support rod, and commonly aligned to project said laser beams therefrom at a target on a workpiece.

8. A method of using said shotpeen nozzles according to claim 7 comprising:

turning on said lasers to project corresponding laser beams from said nozzles to said workpiece;

aligning said nozzles on said common support rod to aim said laser beams at a common target on said workpiece;

turning off said lasers; and discharging a stream of shot in pressurized air from each of said nozzles toward said workpiece for shot peening thereof.

9. An apparatus for shot peening a workpiece comprising:

a plurality of shotpeen nozzles mounted by corresponding brackets to a common support rod;

each of said nozzles including a bowed carbide core mounted in a metal casing, with said casing having an inlet at one end for receiving shot in a stream with pressurized air, and said core having an outlet at an opposite end for discharging said streams;

each of said nozzles further including a laser mounted in said casing for projecting a laser beam in parallel with said core at said outlet in the direction of discharge of said stream therefrom; and means for discharging said shot stream from each of said nozzles toward said workpiece for shot peening thereof.

10. An apparatus according to claim 9 wherein:

each of said cores further includes a bend disposed between said inlet and outlet, and an access hole extending through said bend and coaxially aligned with said bore; and said lasers are mounted in said casings behind said bends, and coaxially aligned with said holes and bores for projecting said laser beams coaxially through said core outlets.

11. A shotpeen nozzle comprising:

an abrasion resistant tubular core mounted in a casing;

said casing having an inlet at a proximal end for mounting a hose in flow communication with said core to receive shot in a stream with pressurized air;

said core having an outlet at an opposite distal end of said casing for discharging said stream; and a laser mounted to said casing for projecting a laser beam in parallel with said core at said outlet in the direction of discharge of said stream therefrom.

12. A nozzle according to claim 11 wherein said casing further includes a pocket surrounding said laser in most part to protect said laser from ricochet of said shot.

13. A nozzle according to claim 12 wherein:

said core further includes a bore extending between said inlet and outlet at opposite ends thereof; and said laser is mounted in said casing to project said laser beam coaxially with said bore at said core outlet.

14. A nozzle according to claim 13 wherein:

said core further includes a bend disposed between said inlet and outlet, and a hole extending through said bend and coaxially aligned with said bore; and said laser is mounted in said casing behind said bend and coaxially aligned with said hole and bore for projecting said laser beam therethrough and out said outlet.

15. A nozzle according to claim 14 wherein said core is straight on opposite sides of said bend, with an obtuse bend angle therebetween.

16. A nozzle according to claim 14 wherein said hole has a diameter corresponding with the diameter of said laser beam, and is a minor portion of the diameter of said bore.

17. A plurality of shotpeen nozzles according to claim 14 mounted by corresponding brackets to a common support rod, and commonly aligned to project said laser beams therefrom at a single target on a workpiece.

18. A method of using said shotpeen nozzle according to claim 14 comprising:

turning on said laser to project said laser beam through said bore and out said outlet toward a workpiece;

aligning said nozzle to aim said laser beam at a target on said workpiece;

turning off said laser; and discharging said stream of shot in said pressurized air toward said workpiece for shot peening thereof.

19. A method of shot peening a workpiece comprising:

mounting a plurality of shotpeen nozzles on a common support rod, each of said nozzles having a tubular core mounted in a casing with a laser being aligned in parallel with said core at an outlet thereof;

turning on said lasers to project corresponding laser beams from said nozzles to said workpiece;

aligning said nozzles on said common support rod to aim said laser beams at a common target on said workpiece;

turning off said lasers; and discharging a stream of shot in pressurized air from each of said nozzles toward said workpiece for shot peening thereof.

20. An apparatus for shot peening a workpiece comprising:

a plurality of shotpeen nozzles mounted on a common support rod, each of said nozzles having a tubular core mounted in a casing with a laser being aligned in parallel with said core at an outlet thereof;

said lasers being aligned to aim said laser beams at a common target on said workpiece; and means for discharging a stream of shot in pressurized air from each of said nozzles toward said workpiece for shot peening thereof.

* * * * *